US007608379B2

(12) United States Patent
Kawase et al.

(10) Patent No.: US 7,608,379 B2
(45) Date of Patent: Oct. 27, 2009

(54) TONER AND MANUFACTURING METHOD THEREOF

(75) Inventors: Yoshitaka Kawase, Nara (JP); Satoru Ariyoshi, Nara (JP); Katsuru Matsumoto, Nara (JP); Yoshinori Yamamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 553 days.

(21) Appl. No.: 11/505,977

(22) Filed: Aug. 18, 2006

(65) Prior Publication Data

US 2007/0065746 A1 Mar. 22, 2007

(30) Foreign Application Priority Data

Aug. 18, 2005 (JP) ..... P2005-237663

(51) Int. Cl.
*G03G 9/08* (2006.01)

(52) U.S. Cl. ..... 430/137.19; 430/137.18

(58) Field of Classification Search ..... 430/137.19, 430/137, 18

See application file for complete search history.

(56) References Cited

U.S. PATENT DOCUMENTS

| | | | | |
|---|---|---|---|---|
| 2004/0234878 | A1* | 11/2004 | Miyazaki et al. | 430/108.1 |
| 2006/0035163 | A1* | 2/2006 | Moribe et al. | 430/108.3 |
| 2006/0154163 | A1* | 7/2006 | Kidokoro | 430/108.22 |
| 2006/0251980 | A1* | 11/2006 | Sakata et al. | 430/109.3 |

FOREIGN PATENT DOCUMENTS

| | | | |
|---|---|---|---|
| JP | 7-152202 | | 6/1995 |
| JP | 7-168395 | | 7/1995 |
| JP | 7-168396 | | 7/1995 |
| JP | 7-219267 | | 8/1995 |
| JP | 7-325-429 | | 12/1995 |
| JP | 7-325430 | | 12/1995 |
| JP | 7-333890 | | 12/1995 |
| JP | 7-333899 | | 12/1995 |
| JP | 7-333901 | | 12/1995 |
| JP | 7-333902 | | 12/1995 |
| JP | 8-179555 | | 7/1996 |
| JP | 8-179556 | | 7/1996 |
| JP | 9-230624 | | 9/1997 |
| JP | 9-319159 | A | 12/1997 |
| JP | 2000-194160 | | 7/2000 |
| JP | 2002-6550 | | 1/2002 |
| JP | 2004-294997 | | 10/2004 |
| JP | 2005-70756 | A | 3/2005 |
| JP | 2005-196056 | A | 7/2005 |

* cited by examiner

*Primary Examiner*—Hoa V Le
(74) *Attorney, Agent, or Firm*—Nixon & Vanderhye, P.C.

(57) ABSTRACT

A toner of excellent anti-hot offsetting property, with no variety of the charging performance and suitable as a toner for the development of electrostatic images, and a manufacturing method thereof are provided. At first, a crosslinked resin at least containing a tetrahydrofuran insoluble component and a colorant are dry-kneaded. Next, the obtained kneaded resin product is mixed with an aqueous dispersant solution prepared in advance and they are heated, to form colorant-containing resin particles in a liquid mixture of the kneaded resin product and the aqueous dispersant solution. Then, the liquid mixture is cooled and the colorant-containing resin particles are separated from the liquid mixture.

13 Claims, 1 Drawing Sheet

TONER AND MANUFACTURING METHOD THEREOF

BACKGROUND OF THE INVENTION

1. Field of the Invention

The present invention relates to a toner used for the development of electrostatic images in the image forming process, for example, by electrophotography, as well as a manufacturing method thereof.

2. Description of the Related Art

Along with remarkable development of recent OA (Office Automation) equipment, image forming apparatus such as printers, facsimile units and copiers have been popularized generally. As the image forming apparatus, electrophotographic image forming apparatus of forming images by electrophotography has been often used. In the electrophotographic image forming apparatus, images are formed by utilizing a photoconductive material. Specifically, after forming static charges by various means on the surface of an electrophotographic photoreceptor having a photosensitive layer containing photoconductive material (hereinafter also simply referred to as "photoreceptor"), static charges are developed by supplying a toner to the surface of the toner receptor and the formed toner images are fixed to a transfer material such as paper thereby forming images.

The toner used for the development of static charges (hereinafter referred to as "toner for static charge development") comprises a colorant dispersed in a resin having a binding property referred to as a binder resin and, optionally, contains various additives such as a charge controller. The toner is charged by triboelectric charging and supplied while being carried on a developing roller or the like to the surface of the photoreceptor.

The manufacturing method of the toner for electrostatic image development is generally classified into a dry process and a wet process. The dry process includes, for example, a pulverization method of kneading a binder resin, a colorant, etc. and pulverizing and granulating the obtained kneaded resin product. While the dry process has been industrially used generally, since the toner obtained by the dry process has a relatively wide grain size distribution, it tends to vary the charging performance.

In a case of forming images by using the toner with varied charge performance, it results in a problem of lacking in the applied charged amount to result in a toner not transferred to the transfer material, lowering the transferability of toner images to the transfer material and resulting in lowering of the image density or white background fog. Furthermore, in a case of a color toner, a problem of causing color shedding to images is arises. The white background fogging is a phenomenon that the toner is deposited to a portion of the transfer material which should be a white background with no deposition of the toner.

For suppressing the variety of the toner charging performance in the dry process, for example, in the pulverization method, it is necessary to apply classification after granulating by pulverization thereby making the grain size distribution narrow, which results in another problem of increasing the manufacturing cost.

On the other hand, since the wet process has an advantage capable of manufacturing a toner with a narrow grain size distribution and having less variety of the charging performance compared with the dry process relatively easily, the wet process has often been adopted recently for the manufacture of the toner. For the wet process, there have been proposed methods, for example, (i) a suspension polymerization method of polymerizing a monomer of a binder resin dispersed by a suspension stabilizer in a dispersion medium such as water under the presence of a colorant and incorporating the colorant in the resultant binder resin particles to obtain a toner;

(ii) an agglomeration method by a emulsion polymerization of mixing a liquid resin dispersion and a liquid colorant dispersion formed by dispersing a colorant in a dispersion medium-to form agglomerated particles, and heating to fuse the agglomerated particles to obtain a toner;

(iii) a phase transfer emulsification method of dissolving or dispersing a water dispersible resin and a colorant in an organic solvent, adding thereto a neutralizing agent for neutralizing dissociation groups of the water dispersible resin and water under stirring, forming resin droplets incorporating the colorant or the like, and emulsifying them under phase transfer to form a toner;

(iv) a dissolving suspension method of dissolving or dispersing a toner material containing a binder resin and a colorant in an organic solvent to which the binder resin is soluble, mixing the resultant solution or the liquid dispersion with an aqueous solution of an inorganic dispersant, for example, of a less water-soluble alkaline earth metal salt such as calcium phosphate or calcium carbonate thereby conducting granulating, and then removing the organic solvent to obtain a toner refer, (for example, refer to Japanese Unexamined Patent Publications JP-A Nos. 7-152202 (1995), 7-168395 (1995), 7-168396 (1995), 7-219267 (1995), 8-179555 (1996), 8-179556 (1996), and 9-230624 (1997)); and (v) an emulsifying dispersing method of dissolving or dispersing at least a binder solution and a colorant in a non-aqueous organic solvent to which the binder resin is soluble, emulsifying and dispersing the obtained solution or liquid dispersion in an aqueous liquid dispersion, and then removing the organic solvent to obtain a toner (for example, refer to Japanese Unexamined Patent Publications JP-A 7-325429 (1995), 7-325430 (1995), 7-333890 (1995), 7-333899 (1995), 7-333901 (1995), and 7-333902 (1995)).

However, the wet processes also involves problems to be solved. For example, the suspension polymerization method (i) involves a problem that the monomer of the binder resin, polymerization initiator, suspension stabilizer, etc. remain in the inside or on the surface of the obtained toner particles to bring about variety of the charging performance of the toner particles. In order to suppress the variety of the charging performance, while it is necessary to remove residues, it is extremely difficult to remove the monomer, polymerization initiator, suspension stabilizer, etc. intruded in the inside of the toner particles. Furthermore, since the removal of the residues requires complicated steps, they result in the problem of increasing the toner manufacturing cost. Furthermore, since the monomer of the binder resin, etc. gives a large burden on the environments, it requires a processing facility for appropriately treating them, which further increases the production cost. Furthermore, in the suspension polymerization method, since the polymerizing reaction is accompanied during granulating, it also has a problem that the binder resin usable therein is restricted to acrylic resins.

Furthermore, in the agglomeration method by emulsion polymerization (ii), since the toner is manufactured by agglomerating the binder resin and the colorant and heat fusing them, this results in a problem that toner particles of a uniform composition can not be formed stably.

Furthermore, in the phase transfer emulsification method (iii), the dissolving suspension method (iv), and the emulsification dispersion method (v), since an organic solvent is used for dissolving or dispersing the binder resin, they result in a problem that a small amount of the organic solvent remains in the obtained toner particles to change the dispersion state and the composition for each of the ingredients in the toner particles on every production lots to vary the charging performance of the toner particles. Furthermore, since the shape of the toner particles is changed by the level of pressure, that is, degree of depressurization upon removing the organic solvent, temperature, time, etc., toner particles of a uniform shape can not be formed stably which may possibly vary the charging performance.

Furthermore, in a case of using the organic solvent, since the amount for each of the ingredients contained in the toner particles, that is, the composition of the toner particle changes depending on the solubility or the dispersibility of the binder resin to the solvent, it is difficult to manufacture a toner having a desired characteristic at a good reproducibility. Furthermore, since the organic solvent gives a significant burden on the environments, the methods (iii) to (v) require a facility of appropriately disposing the removed organic solvent, which increases the production cost of the toner.

Furthermore, in the dissolving suspension method (iv) and the emulsifying dispersing method (v), since the binder resin is granulated by dissolving in the organic solvent to which the binder resin is soluble and mixing with a dispersant or an emulsifier, a resin soluble to the organic solvent, for example, a linear resin of a relatively low molecular weight, for example, with a weight average molecular weight of about 10,000 to 50,000 is used as the binder resin. Accordingly, when images are formed by using the toner produced by the solvent suspension method or emulsifying and dispersing method, this results in a problem of causing hot offsetting phenomenon. The hot offsetting phenomenon means such a phenomenon that the toner is melted excessively during fixing in a hot roller fixing method of conducting fixing by heating the toner by the fixing heat roller, and a portion of the molten toner is carried away being fused on the fixing heat roller and transferred to a subsequent transfer material.

For the method of preventing the hot offsetting phenomenon, while an anti-offsetting solution such as a silicone oil has been coated to the fixing heat roller, the method involves a problem of complicating the apparatus and making the maintenance troublesome.

As a method of preventing the hot offsetting phenomenon with a view point of the toner material, it may be considered to improve the anti-hot offsetting property of the toner by using a resin of high molecular weight with a weight average molecular weight, for example, of about 50,000 to 500,000 or a resin containing a gel ingredient insoluble to tetrahydrofuran (hereinafter referred to as tetrahydrofuran insoluble component or tetrahydrofuran insoluble ingredient) for the binder resin. However, since the resin is not dissolved or less dissolved to the organic solvent, it is difficult to granulate toner particles when intending to manufacture the toner by the solvent suspension method or emulsifying and dispersing method using such toner. Even when the toner particles could be granulated, it is difficult to form toner particles of a desired composition at a good reproducibility. Particularly, the composition of the resin used as the starting material can not often be maintained and since only the ingredients soluble to the solvent are contained in the obtained toner particles, it is difficult to suppress the hot offsetting phenomenon.

As a method of manufacturing the toner incorporated with a toner resin containing the tetrahydrofuran insoluble component, it has been proposed a method of obtaining a toner by mixing a mixture formed by kneading a binder resin, a colorant, a wax, and an organic solvent in a wet process with an aqueous medium to emulsify and form a resin particles incorporating a colorant or the like, and separating the resin particles from the liquid medium followed by drying (refer to Japanese Unexamined Patent Publication JP-A 2002-6550). However, in the method disclosed in JP-A 2002-6550, since the organic solvent is used, it results in a problem that the organic solvent remains in the toner particles to vary the charging performance like in the methods described in (iii) to (v) described above.

As a method of manufacturing a toner without using the organic solvent, it has been proposed a method of manufacturing the toner by mixing and mechanically. dispersing a molten product obtained by heat melting a kneading product of a synthetic resin (binder resin) having ionic groups and a colored pigment and an aqueous medium containing a material for neutralizing the ionic groups and heated to a temperature higher than the softening point of the synthesis resin, then rapidly cooling the same to prepare an aqueous dispersion of fine colored resin particles and drying and separating the fine colored resin particles from the aqueous dispersion solution (for example, refer to Japanese Patent No. 3351505).

However, the technique disclosed in Japanese Patent No. 3351505, involves a problem that formed fine colored resin particles (hereinafter also referred to as toner particles) adhere to each other to grow in the dispersing step and the cooling step. For preventing the growing, it is-necessary to strictly control conditions such as a liquid temperature of the liquid mixture of the molten product and the aqueous medium. For example, in Example 1 of Japanese Patent No. 3351505, the temperature of the liquid mixture has to be cooled rapidly from 165° C. to 65° C. within 10 sec. Actually, it is extremely difficult to apply such control which makes the manufacturing steps complicated.

Furthermore, in the technique disclosed in Japanese Patent No. 3351505, since the binder resin is emulsified by neutralizing the ionic groups in the binder resin with the neutralizing material to disperse the same in the aqueous medium, it has a problem that the resin usable therein is restricted only to those resins having ionic groups. Furthermore, a reverse neutralizing step of resuming the ionic groups of the binder resin in the formed toner particles into the original shape is necessary after the granulating, and this increases the manufacturing steps. Furthermore, since it is difficult to apply reverse neutralization to the ionic groups in the binder resin incorporated in the toner particles, this also results in a problem that the ionic groups remain in the toner particles to vary the charging performance.

SUMMARY OF THE INVENTION

The invention intends to provide a toner excellent in the anti-hot offsetting property, with no scattering in the charging performance and suitable to a toner for use in the development of electrostatic images, as well as a manufacturing method thereof.

The invention provides a toner manufacturing method comprising:

a dry kneading step of dry kneading a crosslinked resin at least containing a tetrahydrofuran insoluble component and a colorant, a granulating step of mixing a kneaded resin product obtained by the dry kneading and an aqueous dispersant solution containing a dispersant, and heating or heating and pressurizing them to form colorant-containing resin particles in the liquid mixture of the kneaded resin product and the aqueous dispersant solution, a cooling step of cooling the liquid mixture containing the formed colorant-containing resin particles, and a separation step of separating the colorant-containing resin particles from the liquid mixture.

According to the invention, the toner is manufactured by way of a dry kneading step, a granulating step, a cooling step, and a separation step. In the dry kneading step, at least a crosslinked resin containing a tetrahydrofuran insoluble component (hereinafter also referred to as THF insoluble component) and a colorant. In the granulating step, colorant-containing resin particles are formed in the liquid mixture of the kneaded resin product and the aqueous dispersing solution by mixing the kneaded resin product obtained by dry kneading and the aqueous dispersant solution, and heating or heating and pressurizing them. The colorant-containing resin particle is the resin particle at least containing the colorant and, in a case where an additive such as a wax is kneaded together with the crosslinked resin and the colorant in the dry kneading step and incorporated in the kneaded resin product, it means the resin particle also containing such additive. In the cooling step, the liquid mixture containing the formed colorant-containing resin particles is cooled. In the separation step, the colorant-containing resin particles are separated from the cooled liquid mixture. This can provide the colorant-containing resin particles as the toner particles. The toner particle means herein a particle granulated from a kneaded resin product containing at least the crosslinked resin and the colorant, the toner means toner particle per se in a case where an external additive such as a surface modifier is not externally added to the toner particle and a composition containing the toner particle and the external additive in a case where the external additive such as a surface modifier is added externally to the toner particle.

In the granulating step, since the kneaded resin product is heated or heated and pressurized in the presence of the dispersant to reach a molten state, even when the crosslinked resin containing the THF insoluble component is incorporated as the binder resin, this is stabilized by the dispersant, uniformly dispersed in the liquid mixture of the kneaded resin product and the dispersant aqueous solution and granulated as colorant containing resin particles of uniform shape and size. Since the colorant-containing resin particles just after formation are in a surface-molten state and has adhesiveness, it may be a possibility that the colorant-containing resin particles are adhered to each other and grow in the cooling step. However, in the toner manufacturing method according to the invention, since the dispersant is contained in the liquid mixture in which the formed colorant-containing resin particles are contained, the colorant-containing resin particles are stabilized by the dispersant. Accordingly, in the cooling step, the colorant-containing resin particles can be cooled without growing while maintaining the shape and the size thereof in a state uniformly dispersed in the liquid mixture. By separating the colorant-containing resin particles from the cooled liquid mixture as described above, toner particles having a volume average grain size as large as about from 3 to 15 μm, with narrow grain size distribution and having uniform shape and size can be obtained. Furthermore, since the dispersant can be removed easily from the surface of the colorant-containing resin particles, it is possible to prevent the dispersant from remaining on the surface of the toner particles and obtain toner particles with smooth surface excellent in the surface smoothness. Furthermore, since the crosslinked resin is incorporated in the colorant containing resin particles, a toner of excellent anti-hot offsetting property could be obtained. Furthermore, in the manufacturing method of the toner according to the invention, since the resin less soluble or dispersible to an organic solvent as the crosslinked resin can also be used with no particular restriction so long as the resin is melting by heating a toner having various characteristics can be obtained easily.

Accordingly, the toner manufacturing method of the invention has the following advantages.

(1) The obtained toner particles have a volume average grain size of about 3 to 15 μm which is suitable as a toner for use in development of static charges, have narrow grain size distribution, uniform size and uniform shape, and are also excellent in the surface smoothness. Furthermore, since the organic solvent, the binder resin monomer, etc. are not used, it is possible to prevent them from remaining in the toner particles. Accordingly, since the toner of the invention has uniform charge performance with no variety and is excellent in the transferability to a transfer material, it is extremely effective as the toner for use in development of electrostatic images used for image formation by electrophotography. Since the transfer ratio of the toner to the transfer material can be increased to about 90% or more by using the toner according to the invention, images of high quality with high image density (optical reflection density) of 1.4 or more and with no image defects such as white background fogging can be formed easily.

(2) Furthermore, since the organic solvent is not used, it is possible to prevent that the amount of each of ingredients such as the binder resin and the colorant in the obtained toner particles is changed by the solubility or dispersibility to the organic solvent used. Accordingly, a toner having a uniform composition can be manufactured stably. Furthermore, since it requires no steps for removing the organic solvent, it is free from the disadvantage that the shape of the toner particles become not uniform upon removal of the organic solvent.

(3) Different from the dissolution suspension method (ii) or the emulsification dispersing method (v) described above using the organic solvent, any resin that is melted by heating can be used irrespective of the kinds as the binder resin. Accordingly, the range of the resin usable as the binder resin is extended more than that in the existent wet process and since different kinds of resins can be used in combination, control for the hot offsetting property and low temperature fixing property of the obtained toner particles can be controlled easily. Particularly, since even those resins not dissolved or less dissolved in the organic solvent such as a crosslinked resin containing the THF insoluble component which was difficult to be used so far can be used as the binder resin, a toner excellent in the anti-hot offsetting property can be attained easily. Furthermore, by the use of the crosslinked resin containing the THF insoluble component, a toner with an average circularity of the toner particles of 0.90 or more and less than 0.97 can be obtained easily. By the use of the toner described above, occurrence of cleaning failure, etc. can be suppressed.

Furthermore, in the invention, it is preferable that the crosslinked resin contains the tetrahydrofuran insoluble component by 0.5% by weight or more and 30% by weight or less.

According to an embodiment of the invention, the tetrahydrofuran (THF) insoluble matter of the crosslinked resin is 0.5% by weight or more and 30% by weight or less. By using the crosslinked resin with the THF insoluble component in the range described above as the crosslinked resin, a toner excellent both in the low temperature fixing property and the anti-hot offsetting property can be attained easily.

Furthermore, in the invention, it is preferable that a softening point of the crosslinked resin is equal to or lower than 150° C.

Furthermore, in the invention, it is preferable that a softening point of the crosslinked resin is within a range of 60° C. to 150° C.

According to the invention, by employing a crosslinked resin having a softening point within the range mentioned above, the mixing operation with the aqueous dispersant solution and granulating operation in the granulating step can be made easier, with the result that a toner which is uniform in form and in size can be obtained.

Furthermore, it is preferable that a glass transition point of the crosslinked resin is within a range of 30° C. to 80° C.

Furthermore, it is preferable that a glass transition point of the crosslinked resin is within a range of 40° C. to 70° C.

According to the invention, by employing a crosslinked resin having a glass transition within the range mentioned above, a toner of desired low-temperature fixing property and store stability can be obtained.

Furthermore, in the invention, it is preferable that a weight average molecular weight of the crosslinked resin is within a range of 5,000 to 500,000.

According to the invention, by employing a crosslinked resin having a weight average molecular weight of 5,000 to 500,000, it is possible to prevent the broken in kneading and the tetrahydrofuran insoluble component from being decreased.

Furthermore, in the invention, it is preferable that the crosslinked resin is a crosslinked polyester resin.

According to an embodiment of the invention, the crosslinked resin is a crosslinked polyester resin. By the use of the crosslinked polyester resin as the crosslinked resin, the low temperature fixing property of the toner can be improved. Further, the toner can be provided with satisfactory powder fluidity to suppress agglomeration inside the developing apparatus. Further, a tone excellent in the light permeability, having satisfactory secondary color reproducibility and suitable as the color toner can be obtained. The secondary color reproducibility means reproducibility of a color upon expressing a color by stacking color toners of plural colors.

Furthermore, in the invention, it is preferable that the dispersant is a water-soluble polymeric compound.

According to an embodiment of the invention, the dispersant is a water-soluble polymeric compound. Since granulating of the kneaded resin product tends to proceed easily by using the water-soluble polymeric compound as the dispersant, colorant-containing particles (toner particles) having smooth surface and uniform size and shape can be obtained efficiently. Further, since the dispersant can be removed from the surface of the colorant-containing resin particles by a simple operation of cleaning with water, this is excellent in the productivity and industrially advantageous.

Furthermore, in the invention, it is preferable that a weight average molecular weight of the water-soluble polymeric compound is within a range of 5,000 to 50,000.

Furthermore, in the invention, it is preferable that a weight average molecular weight of the water-soluble polymeric compound is within a range of 5,000 to 20,000.

According to the invention, by employing the water-soluble polymeric compound having a weight average molecular weight within the range mentioned above, the effect of the water-soluble polymeric compound as a dispersant can be prevented from being interfered.

Furthermore, in the invention, it is preferable that the water-soluble polymeric compound is a polycarboxylic acid compound.

According to an embodiment of the invention, the water-soluble polymeric compound used as the dispersant is a polycarboxylic acid compound. By the use of the polycarboxylic acid compound as the dispersant, since the granulating of the kneaded resin product proceeds further easily, colorant-containing resin particles (toner particles) having uniform shape and size can be obtained further efficiently. Further, since the polycarboxylic acid compound can be removed easily with water washing, the dispersant can be prevented from remaining on the surface of the colorant-containing resin particles more reliability by using the polycarboxylic acid compound.

Furthermore, in the invention, it is preferable that a wax is further kneaded together with the crosslinked resin and the colorant in the dry kneading step.

According to the invention, a wax is further kneaded together with the crosslinked resin and the colorant in the dry kneading step. Since this can provide a wax-incorporated toner, the anti-offsetting property of the toner can be improved further.

Furthermore, the invention provides a toner comprising at least a crosslinked resin containing a tetrahydrofuran insoluble component and a colorant, and has an average circularity within a range of 0.90 or more to less than 0.97.

Furthermore, the invention provides a toner manufactured by the toner manufacturing method mentioned above, comprising at least a crosslinked resin containing a tetrahydrofuran insoluble component and a colorant, and has an average circularity within a range of 0.90 or more to less than 0.97.

According to an embodiment of the invention, the toner at least contains the crosslinked resin containing the tetrahydrofuran insoluble component and a colorant in which the circularity is 0.90 or more and less than 0.97. This can provide a toner excellent in the anti-hot offsetting property and not causing cleaning failure or the like.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
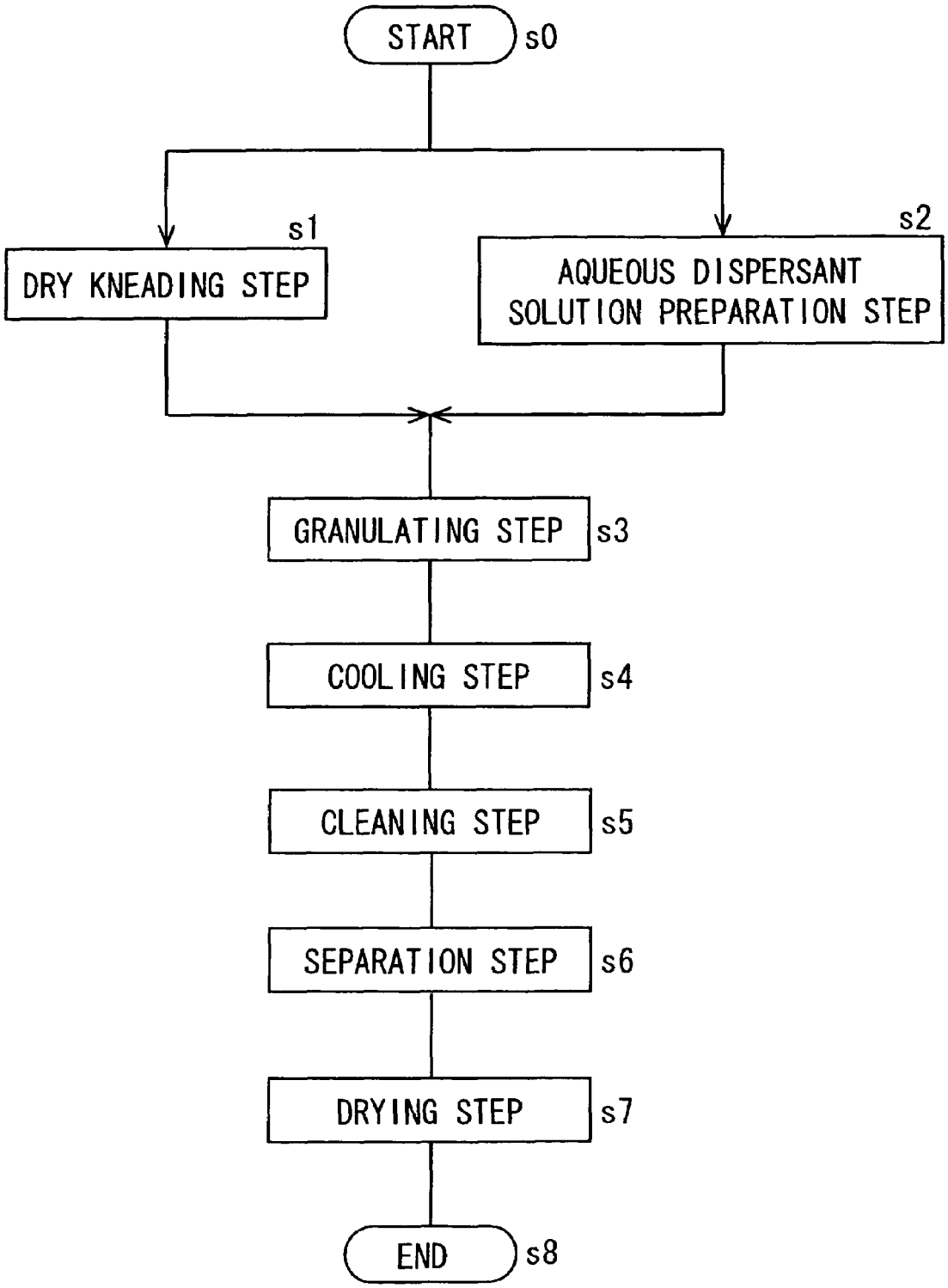
FIG. 1 is a flow chart showing the procedures for the toner manufacturing method as an embodiment of the invention.

Now referring to the drawings, preferred embodiments of the invention are described below.

FIG. 1 is a flow chart showing the procedure of toner manufacturing method as an embodiment of the invention. The toner manufacturing method according to the invention includes at least a dry kneading step, a granulating step, a cooling step, and a separation step. This embodiment further includes a step for preparing a dispersant aqueous solution, a cleaning step and drying step. That is, the toner manufacturing method according to this embodiment includes a dry kneading step (step s1), a dispersant aqueous solution preparation step (step s2), a granulating step (step s3), a cooling step (step s4), a cleaning step (step s5), a separation step (step s6), and a drying step (step s7) . Manufacture of the toner according to this embodiment is started at the step s0 and transfers to the step s1 and the step s2. Either the dry kneading step as the step s1 or the dispersant aqueous solution preparation step as the step s2 is conducted previously. Further, the cleaning step as the step s5 may be conducted after the separation step as the step s6 and before the drying step as the step s7.

[Dry Kneading Step]

In the dry kneading step as the step s1, at least the binder resin and the colorant are dry kneaded to prepare a kneaded resin product. The dry kneading is kneading conducted without using the organic solvent. The kneaded resin product may optionally contain additives, for example, a releasing agent such as wax and an additive such as a charge controller. The additives are kneaded together with the binder resin and the colorant and dispersed in the kneaded resin product.

(a) Binder Resin

As the binder resin, a crosslinked resin containing a tetrahydrofuran insoluble component (hereinafter referred to as THF insoluble component) is used. The THF insoluble component is an ingredient which is insoluble to tetrahydrofuran (simply referred to as THF) in the resin. In the crosslinked resin, the crosslinked component is gelled and insolubilized, which forms the THF insoluble component. In the invention, the ratio (wt %) of the THF insoluble component in the resin is determined by the following method.

[Measuring Method for THF Insoluble Component]

At first, 1 g of a sample is placed in a cylindrical filter paper and subjected to a Soxhlet extractor. It is refluxed under heating for 6 hours by using 100 mL of tetrahydrofuran as a solvent and an ingredient in the sample soluble to THF (hereinafter sometimes referred to as THF soluble ingredient) is extracted with THF. After removing the solvent from the liquid extracts containing the extracted THF soluble ingredient, the THF soluble ingredient is dried at 100° C. for 24 hours and the weight W (g) of the obtained THF soluble ingredient is weighted. The content P of the THF insoluble component in the resin (wt %) is calculated according to the following equation (1) based on the weight W of the determined THF soluble ingredient (g) and the weight (1 g) of the sample used for the measurement:

$$P(\text{wt }\%)=\{1(\text{g})-W(\text{g})\}/1(\text{g})\times 100 \quad (1)$$

Since the crosslinked resin containing the THF insoluble component (hereinafter simply referred to as a crosslinked resin) is excellent in the elasticity compared with a resin not containing the THF insoluble component, the elasticity of the toner can be improved by using the crosslinked resin containing the THF insoluble component. Since the releasability between the transfer material and the fixing heat roller during fixing can be improved by forming images using such a toner, even in a case of fixing at a low temperature, occurrence of damages to images by a releasing finger provided for preventing twining of the transfer material to the fixing heat roller can be suppressed.

Further, since the crosslinked resin containing the THF insoluble component is harder compared with the resin not containing the THF insoluble component, occurrence of fine powder is reduced by using the crosslinked resin containing the THF insoluble component and toner particles of narrow grain size distribution and having uniform size can be obtained easily. Further, toner particles of an average circularility of 0.90 or more and less than 0.97 can be obtained easily. In a case of using the toner comprising toner particles with a shape approximately to a true spherical shape with an average circularity of 0.97 or more and 1.00 or less, a so-called cleaning failure may sometimes occur in which the toner remaining on the image carrier such as a photoreceptor can not completely be removed by a cleaning apparatus. On the contrary, in a case of using the toner comprising toner particles with the average circularity of 0.90 or higher and less than 0.97 as described above, occurrence of cleaning failure can be suppressed.

The THF insoluble component contained in the crosslinked resin is preferably 0.5% by weight or more and 30% by weight or less based on the entire amount of the crosslinked resin. By the use of the crosslinked resin with the content of the THF insoluble component in the range described above, a toner excellent both in the anti-hot offsetting property and the low temperature fixing property can be obtained easily. Further, toner particles with the average circularity of 0.90 or more and less than 0.97 as described above can be obtained easily.

In a case where the THF insoluble component is less than 0.5% by weight, since the elasticity of the crosslinked resin decreases, sufficient anti-hot offsetting property may not possibly be obtained. In a case where the THF insoluble component exceeds 30% by weight, it may be a possibility that the granulating property of the kneaded resin product is worsened in the granulating step to be described later and the product can not be granulated. Further, even when granulating is possible, it may be a possibility that the grain size distribution becomes broader to worsen the toner characteristics such as variance of the charging performance. In addition, it may be a possibility that no sufficient low temperature fixing property can be obtained.

It may be a possibility that the crosslinked portion as the tetrahydrofuran insoluble component of the crosslinked resin is disconnected during kneading in the dry kneading step to decrease the tetrahydrofuran insoluble component compared with that before kneading. In order to provide the effect of the invention sufficiently, it is preferred that the crosslinked resin contains an appropriate amount of the tetrahydrofuran insoluble component also in the kneaded resin product and the toner. That is, it is necessary for the crosslinked resin to contain the tetrahydrofuran insoluble component both before and after kneading, and after formulation into the toner and it is preferred that the resin contains the tetrahydrofuran insoluble component at a ratio of 0.5% by weight or more and 30% by weight or less. Disconnection of the crosslinked ingredient during kneading can be suppressed, for example, by selecting the molecular weight of the crosslinked resin before kneading within an appropriate range. By properly selecting the weight average molecular weight of the crosslinked resin within a range, for example, of 5,000 or more and 500,000 or less, disconnection of the crosslinked ingredient during kneading can be suppressed to suppress the decrease in the THF insoluble component as described later.

While the softening point of the crosslinked resin is not particularly restricted and can be selected properly from a wide range, it is, preferably, 150° C. or lower and, more preferably, 60° C. or higher and 150° C. or lower in view of the kneading property with the colorant and the additive such as a wax, easy operation of mixing with the aqueous dispersant solution and the granulating operation during the granulating step as the step s3. In a case where the softening point of the crosslinked resin exceeds 150° C., kneading with the colorant, the additive, etc. becomes difficult to possibly deteriorate the dispersibility of the colorant, the additive, etc. Further, mixing with the aqueous dispersant solution and granulating becomes difficult to possibly make the shape and the size of the obtained toner particles not uniform. Further, the fixing property of the obtained toner to the transfer material is deteriorated to possibly cause fixing failure. In a case where the softening point of the crosslinked resin is lower than 60° C., the glass transition point (Tg) of the crosslinked resin tends to approach the normal temperature to possibly cause thermal agglomeration of the toner in the inside of the image forming apparatus to induce printing failure, troubles in the apparatus, etc. In addition, this may also tend to cause twining of the transfer material to a heat roller for use in fixing, hot offsetting phenomenon, etc.

While the glass transition point (Tg) of the crosslinked resin is not particularly restricted and can be properly selected from a wide range, it is, preferably, 30° C. or higher and 80°

C. or lower and, more preferably, 40° C. or higher and 70° C. or lower in view of the low temperature fixing property and the store stability of the obtained toner. In a case where the glass transition point (Tg) of the crosslinked resin is lower than 30° C., the store stability becomes insufficient and the thermal agglomeration of the toner tends to occur in the inside of the image forming apparatus to possibly result in printing failure, offset phenomenon, etc. In a case where the glass transition point (Tg) of the crosslinked resin exceeds 80° C., the fixing property of the obtained toner to the transfer material is deteriorated to cause a possibility that no sufficient low temperature fixing property can be obtained.

While the molecular weight of the crosslinked resin is not particularly restricted and can be selected properly from a wide range, it is, preferably, 5,000 or more and 500,000 or less in view of the weight average molecular weight, in view of the kneading property with the colorant and the additive such as a wax, easy mixing operation with the aqueous dispersant solution and the granulating operation in the granulating step as the step s3, the uniformness of the shape and the size of the obtained toner particles, and the fixing property to the transfer material. In a case where the weight average molecular weight of the crosslinked resin is less than 5,000, the mechanical strength thereof becomes lower than the mechanical strength required for the binder resin for use in the toner, the crosslinked ingredient as the THF insoluble component is disconnected during kneading with the colorant, etc. and the amount of the THF insoluble component in the crosslinked resin decreases to a value less than a desired value to possibly cause a possibility that no sufficient anti-hot offsetting property of the toner can be obtained. Further, the obtained toner particles are pulverized for example, by stirring in the inside of the developing apparatus, and the shape of the particles is changed to possibly cause variety of the charging performance. In a case where the weight average molecular weight of the crosslinked resin exceeds 500,000, kneading with the colorant, the additive, etc. becomes difficult to possibly lower the dispersibility of the colorant and the additive. Further, the glass transition temperature (Tg) of the crosslinked resin tends to exceed 80° C. and the fixing property of the obtained toner to the transfer material is deteriorated to result in a possibility that no sufficient low temperature fixing property can be obtained. The weight average molecular weight of the crosslinked resin is a value measured by gel permeation chromatography (simply referred to as GPC).

The crosslinked resin containing the THF insoluble component is not particularly restricted so long as the resin can be melted by heating, and known synthetic resins used as the binder resin for the toner can be used. In view of the powder fluidity, the low temperature fixing property, etc. of the obtained toner particles, a crosslinked polyester resins is preferred. Since the crosslinked polyester resin can provide a color toner also excellent in the light permeability and excellent in the secondary color reproducibility, it is suitable as the binder resin for color toner. The crosslinked polyester resin means herein a polyester resin containing the THF insoluble component.

The crosslinked polyester resin is not particularly restricted and known resins can be used including, for example, poly-condensation products of polybasic acids and polyhydric alcohols. The polybasic acids are polybasic acids and derivatives thereof, for example, acid anhydrides or esterification products of the polybasic acids. Further, the polyhydric alcohols are compounds having two or more hydroxyl groups including both alcohols and phenols.

For the polybasic acids, those used customarily as monomers of polyester resins can be used including, for example, aromatic carboxylic acids, and aliphatic carboxylic acids. Specifically, the aromatic carboxylic acids include, for example, aromatic dicarboxylic acids such as an aromatic dicarboxylic acid, for example, terephthalic acid, isophthalic acid, or naphthalene dicarboxylic acid, and acid anhydride (for example, phthalic acid anhydride) or esterification product thereof, and tri- or higher basic aromatic carboxylic acids, for example, a tri- or higher basic aromatic carboxylic acid such as trimellitic acid (benzene-1,2,4-tricarboxylic acid), trimesinic acid (benzene-1,3,5-tricarboxylic acid), naphthalene-1,2,4-tricarboxylic acid, naphthalene-2,5,7-tricarboxylic acid, or pyrromellitic acid (benzene-1,2,4,5-tetracarboxylic acid), and acid anhydride (for example, trimellitic acid anhydride) or esterification product thereof. The aliphatic carboxylic acids include, for example, aliphatic dicarboxylic acids such as an aliphatic dicarboxylic acid, for example, maleic acid, fumaric acid, succinic acid, or adipic acid, and acids anhydride (for example, maleic acid anhydride and alkenyl succinic acid anhydride), or esterification product thereof. The alkenyl succinic acid anhydride comprises various kinds of olefins with addition of maleic acid anhydride, and specific examples thereof include, for example, hexadecenyl succinic acid anhydride, heptadecenyl succinic acid anhydride, octadecenyl succinic acid anhydride, tetrapropenyl succinic acid anhydride, dodecenyl succinic acid anhydride, triisobuteny succinic acid anhydride, or 1-methyl-2-pentedecenyl succinic acid anhydride. The polybasic acids can be used each alone, or two or more of them can be used together.

Among the polybasic acids described above, use of the aromatic carboxylic acids is preferred. Further, for obtaining the crosslinked polyester resin containing the crosslinked ingredient, it is preferred to use bivalent polybasic acids such as the aromatic carboxylic acids and aliphatic dicarboxylic acids, together with tri- or higher polybasic acids, for example, the tri- or higher basic aromatic carboxylic acids and tri- or higher basic aliphatic carboxylic acids described above. The amount of the tri- or higher basic acids to be used is, preferably, from 0.1 mol % or more and 20 mol % or less based on the entire amount of the monomer containing the polybasic acids and the polyhydric alcohols. In a case of using the tri- or higher hydric alcohols to be described later as the polyhydric alcohols, the tri- or higher basic acids may not be used.

Also for the polyhydric alcohols, those used customarily as the monomers for the polyester resins can be used including, for example, aliphatic polyhydric alcohols and aromatic polyhydric alcohols. Specifically, the aliphatic polyhydric alcohols include aliphatic diols, such as ethylene glycol, propylene glycol, butane diol, hexane diol, and neopentyl glycol, cycloaliphatic polyhydric alcohols such as cyloalipahtic diols, for example, cyclohexane diol, cyclohexane dimethanol, or hydrogenated bisphenol A, and tri- or higher hydric aliphatic polyhydric alcohols such as glycerine (glycerol), sorbitol, 1,4-sorbitan, 1,2,3,6-hexane tetraol, pentaerythritol, dipentaerythritol, tripentaerythritol, 1,2,4-butane triol, 1,2,5-pentane triol, 2-methylpropane triol, 2-methyl-1,2,4-butane triol, trimethylol ethane, or trimethylol propane.

The aromatic polyhydric alcohols include, for example, aromatic diols such as bisphenol A alkylene oxide adducts, for example, bisphenol A ethylene oxide adduct or bisphenol A propylene oxide adduct, and tri- or higher aromatic polyhydric alcohols such as 1,3,5-trihydroxybenzene. Bisphenol A is 2,2-bis(p-hydroxyphenyl)propane, and the bisphenol A ethylene oxide adduct includes, for example, polyoxyethylene-2,2-bis(4-hydroxyphenyl) propane, and the bisphenol A propylene oxide adduct includes, for example, polyoxypropylene-2,2-bis(4-hydroxyphenyl) propane. The polyhydric alcohols can be used each alone, or two or more of them can be used together.

For obtaining the crosslinked polyester resin containing the crosslinked ingredient, it is preferred to use diols, for example, aliphatic diols, cycloaliphatic diols, and aromatic diols as the polyhydric alcohols together with tri- or higher hydric alcohols such as tri or higher aliphatic polyhydric alcohols and tri- or higher aromatic polyhydric alcohols. The amount of the tri- or higher polyhydric alcohols to be used is, preferably, from 0.1 mol % or more and 20 mol % or less based on the entire amount of the monomer. In a case of using the tri- or higher polybasic acids as the polybasic acids, tri- or higher polyhydric alcohols may not be used.

The crosslinked polyeter resin can be synthesized by usual polycondensating reaction. For example, it can be synthesized by polycondensating reaction, specifically, dehydrating condensation of polybasic acids and polyhydric alcohols in an organic solvent or in the absence of solvent under the presence of a catalyst. In this case, methyl esterification product of a polybasic acid may be used as a portion of the polybasic acid and demethanol polycondensating reaction may be carried out. The polycondensating reaction may be terminated when the acid value and the softening point of the formed polyester resin reach predetermined values. In the polycondensating reaction, the amount of the crosslinked ingredient and, thus, the amount of the THF insoluble component in the obtained polyester resin can be controlled, for example, by properly changing the blending ratio between the polybasic acids and the polyhydric alcohols, and the reaction ratio. Further, the content of carboxylic groups bonded to the terminals of the obtained polyester resin, thus, the acid value of the obtained polyester resin can be controlled and other physical property values such as the softening point can also be controlled.

The crosslinked polyester resins can be used each alone or two or more of them can be used together. Further also for the identical kind of the resins, a plurality species of the resins different in one or more of the molecular amount, monomer composition, etc. can be used together.

Further, the crosslinked polyester resin can be used together with other resins than the crosslinked polyester resin, for example, not-crosslinked polyester resin, polyurethane resin, epoxy resin, and acryl resin. The not-crosslinked polyester resin is a polyester resin not containing the THF insoluble component, that is, with 0% by weight of the THF insoluble component.

By using the crosslinked resin containing the THF insoluble component such as the crosslinked polyester resin and the resin not containing the THF insoluble component such as the not-crosslinked polyester resin (hereinafter referred to as the not-crosslinked polyester resin) in admixture, the fixing property of the obtained toner can be controlled easily and a toner having a desired fixing property can be obtained easily. The resin not containing the THF insoluble component such as the not-crosslinked polyester resin is used preferably within such a range as not deteriorating preferred characteristics of the invention. The not-crosslinked polyester resin can be prepared in the same manner as the crosslinked polyester resin as described above except for not using tri- or higher basic acids and polyhydric alcohols, or using the tri- or higher valent polybasic acids or polyhydric alcohols within such a range that the THF insoluble component in the obtained polyester resin is 0% by weight.

The polyurethane resin is not particularly restricted and known resins can be used including, for example, addition polymerization products of polyol and polyisocyanate. Among them, polyurethane resins having acidic groups or basic groups are preferred. A polyurethane resin having acidic groups or basic groups can be synthesized, for example, by addition polymerizing reaction of a polyol having the acidic group or basic group and a polyisocyanate. The polyol having the acidic group or basic group includes, for example, diols such as dimethyl propionic acid and N-methyl diethanol amine, and tri- or higher hydric polyols such as polyether polyol, for example, polyethylene glycol, polyester polyol, acryl polyol, and polybutadiene polyol. The polyols can be used each alone, or two or more of them can be used together. The polyisocyanate includes, for example, tolylene diisocyanate, hexamethylene diisocyanate, and isophorone diisocyanate. The polyisocyanates can be used each alone or two or more of them can be used together.

Also the epoxy resin is not also restricted particularly and known resins can be used including, for example, a bisphenol A epoxy resin synthesized from bisphenol A and epichlorohydrin, a phenol novolac epoxy resin synthesized from phenol novolac as a reaction product of phenol and formaldehyde, and epychlorohydrin, and a cresol novolac epoxy resin synthesized from cresol novolac as a reaction product of cresol and formaldehyde and epichlorohydrin. Among them, epoxy resins having acidic group or basic group are preferred. An epoxy resin having acidic group or basic group can be prepared, for example, by using the epoxy resin described above as a base and adding or addition polymerizing a polybasic carboxylic acid such as adipic acid or trimellitic acid anhydride, or an amine such as dibutylamine or ethylene diamine to the epoxy resin as the base.

Also the acryl resin is not restricted particularly and known resins can be used including, for example, polycondensation products of acrylic monomers to each other and acrylic monomer and vinylic monomer. Among them, an acrylic resin having acidic group is preferred. As the acrylic monomer, those used customarily as the monomers for the acryl resin can be used including, for example, acrylic acid, methacyrlic acid, acrylate monomer such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate or dodecyl acrylate, and methacrylate monomer such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, or dodecyl methacrylate. The acrylic monomer may have a substituent, and the acryl monomer having the substituent includes, for example, acrylate ester monomer or methacrylate ester monomer having hydroxyl group such as hydroxyethyl acrylate or hydroxypropyl methacrylate. The acrylic monomers can be used each alone or two or more of them can be used together. For the vinylic monomer, known monomers can be used including, for example, aromatic vinyl monomer such as styrene and α-methylstyrene, aliphatic vinyl monomer such as vinyl bromide, vinyl chloride, or vinyl acetate, and acrylonitrile monomers such as acrylonitrile and methacrylonitrile. The vinylic monomers can be used each alone or two or more of them can be used together.

The acrylic resin can be prepared, for example, by polymerizing one or more of acrylic monomers and, optionally, one or more of vinylic monomers by a solution polymerization method, suspension polymerization method, or emulsification polymerization method under the presence of a radical initiator. The acrylic resin having the acidic group can be prepared, for example, by using an acrylic monomer having acidic group or hydrophilic groups and/or a vinylic monomer having acidic group or hydrophilic group together upon polymerization of the acrylic monomer or acrylic monomer and vinylic monomer.

(b) Colorant

As the colorant to be mixed with the binder resin, any of known organic dyes, organic pigments, inorganic dyes and inorganic pigments used as the colorant for toner can be used. Specific examples of the colorant include the following colorants of respective colors to be shown below. In the followings, C. I. means color index.

A black colorant includes, for example, carbon black, copper oxide, manganese dioxide, aniline black, activated carbon, non-magnetic ferrite, magnetic ferrite, and magnetite.

A yellow pigment includes, for example, C. I. pigment yellow 17, C. I. pigment yellow 74, C. I. pigment yellow 93, C. I. pigment yellow 155, C. I. pigment yellow 180, and C. I. pigment yellow 185.

An orange colorant includes, for example, red chrome yellow, molybdenum orange, permanent orange GTR, pyrazolone orange, vulcan orange, indathrene brilliant orange RK, benzidine orange G, indathrene brilliant orange GK, C.I. pigment orange 31, C. I. pigment orange 43.

A red colorant includes, for example, C. I. pigment red 19, C. I. pigment red 48:3, C. I. pigment red 57:1, C. I. pigment red 122, C. I. pigment red 150, and C. I. pigment red 184.

A purple colorant includes, for example, manganese purple, fast violet B, and methyl violet lake.

A blue colorant includes, for example, C. I. pigment blue 15, C. I. pigment blue 15:2, C. I. pigment blue 15:3, C. I. pigment blue 16, and C. I. pigment blue 60.

A green colorant includes, for example, chromium green, chromium oxide, pigment green B, micalite green lake, final yellow green G, and C. I. pigment green 7.

A white colorant includes compound, for example, zinc powder, titanium oxide, antimony white, and zinc sulfide.

The colorants can be used each alone or two or more of them of different colors can be used together. Further, a plurality of colorants of an identical color system can also be used together. The ratio of the colorant used to the binder resin is not particularly restricted and can be properly selected within a wide range in accordance with various conditions such as the kind of the binder resin and the colorant, characteristics required for the toner particles to be obtained, etc. and it is, preferably, from 0.1 part by weight or 20 parts by weight or less, and more preferably, 5 parts by weight or more and 15 parts by weight or less based on 100 parts by weight of the binder resin. In a case where the ratio of the colorant to be used is less than 0.1 part by weight, no sufficient tinting power can be obtained and the amount of the toner required for forming images having a desired image density is increased to possibly increase the toner consumption amount. In a case where the ratio of the colorant to be used exceeds 20 parts by weight, dispersibility of the colorant in the kneaded resin product is deteriorated, failing to obtain a uniform toner.

(c) Additive

The kneaded resin product can contain optionally, in addition to the binder resin and the colorant, usual additives for toner, for example, a releasing agent such as a wax and a charge controller. Among them, the kneaded resin product preferably contains the wax. The anti-hot offsetting property of the toner can be improved by adding the wax to the kneaded resin product. As the wax, those used customarily in this field can be used including, for example, natural waxes such as carnauba wax and rice wax, synthesis waxes such as polypropylene wax, polyethylene wax, and Fischer-Tropsch wax, coal type waxes such as montan wax, petroleum waxes such as paraffin wax, alcohol type waxes, and ester type waxes. Among them, the paraffin wax is used suitably. The waxes can be used each alone or two or more of them can be used together.

The melting point of the wax is, preferably, 60° C. or higher and 140° C. or lower and, more preferably, 70° C. higher and 120° C. or lower. By the use of the wax having the melting point in the range described above, a toner excellent both in the anti-hot offsetting property and the low temperature fixing property can be obtained more easily. In a case where the melting point of the wax is lower than 60° C., the wax is possibly leached from the kneaded resin product by heating in the granulating step as the step s3. Further, toner particles prepared tend to be fused to each other to possibly deteriorate the store stability of the toner. In a case where the melting of the wax exceeds 140° C., the wax is less leached upon fixing the toner to result in a possibility that the effect of improving the anti-hot offsetting property and the low temperature fixing property can not be provided sufficiently. The melting point of the wax is a temperature at the top of a melting peak of a DSC curve obtained in differential scanning calorimetry (simply referred to as DSC).

While ratio of the wax to be used is not particularly restricted and can be selected properly from a wide range in accordance with various conditions such as the kind of the binder resin, the colorant, and the wax, and the characteristics required for the toner particles to be obtained, it is, preferably, 5 part by weight or more and 10 parts by weight or less based on 100 parts by weight of the binder resin. In a case where the ratio of the wax to be used is less than 5 parts by weight, it may be a possibility that the effect of improving the low temperature fixing property and the anti-hot offsetting property can not be provided sufficiently. In a case where the ratio of the wax to be used exceeds 10 parts by weight, the dispersibility of the wax in the kneaded resin product is lowered to result in a possibility that no uniform toner can be obtained. Further, it may be a possibility of causing a phenomenon called as "filming" in which the toner is fused in a film-like state on the surface of an image carrier such as a photoreceptor that carries electrostatic images.

As the charge controller, those used customarily in this field can be used including, for example, calyx arenas, quaternary ammonium salt compounds, nigrosine compounds, organic metal complexes, chelate compounds, metal salts of salicylic acid such as zinc salicylate, and polymeric compounds obtained by homopolymerization or copolymereization of monomers having ionic groups such as sulfonic groups and amino groups. The charge controllers may be used each alone or two or more of them may be used together. While blending amount of the charge controller is not particularly restricted and can be selected properly from a wide range in accordance with various conditions such as the kind of the binder resin, and the kind and the content of the colorant, it is preferably from 0.5 part by weight or more and 5 parts by weight or less based on 100 parts by weight of the binder resin.

The kneaded resin product can be manufactured, for example, by dry mixing an appropriate amount of each of the binder resin containing the crosslinked resin and the colorant and, optionally, an appropriate amount of various kinds of additives such as the wax in a mixer, and melt kneading them by heating to a temperature higher than the melting point of the crosslinked resin, preferably, a temperature higher than the melting point and lower than the heat decomposition temperature of the crosslinked resin, specifically, about at a temperature, preferably, of 80 to 200° C., more preferably, of 100° C. to 150° C. In this embodiment, kneading is conducted by dry kneading without using the organic solvent. By conducting kneading not using the organic solvent, the organic solvent can be prevented from remaining in the obtained toner particles to suppress variance of the charging performance. Materials constituting the kneaded resin product such as the binder resin and the colorant may be served as they are to the dry kneading without dry mixing. However, serving them to the dry kneading after dry mixing as in this embodiment is preferred since this can improve the dispersibility of each of the ingredients such as the colorant to make the characteristics further uniform, for example, of the charging performance of the obtained toner.

As the mixer used for the dry mixing, known mixers can be used including, for example, Henschel type mixing apparatus such as Henschel mixer (trade name of products, manufactured by Mitsui Mining Co. Ltd.), Super mixer (trade name of products manufactured by Kawata Co.), and Mechanomill (trade name of products manufactured by Okada Seiko Co.), Ongumill (trade name of products manufactured by Hosokawa Micron Co.), Hybridization system (trade name of products manufactured by Nara Machinery Co. Ltd.), Cosmo system (trade name of products manufactured by Kawasaki Heavy Industry Co.). For the dry kneading, usual kneading machines such as kneader, two-screw extruder, two roll mill, three roll mill, laboplast mill, etc. can be used. The kneading machine includes, for example, single or twin screw extruder such as, for example, TEM-100B (trade name of products manufactured by Toshiba Kikai Co. Ltd.) and PCM-65/87, PCM-30 (both trade names of products manufactured by Kabushiki Kaisha Ikegai Co.), and open roll kneading machines such as Kneadex (trade name of products manufactured by Mitsui Mining Co.). The dry kneading may also be conducted by using a plurality of kneading machines.

[Preparation Step for Aqueous Dispersant Solution]

In the aqueous dispersant solution preparation step as the step s2, an aqueous dispersant solution containing a dispersant is prepared.

As the dispersant, for easy cleaning in the cleaning step as the step s5, materials easily soluble to water or those materials easily decomposed by an acid or the like and transformed into easily water-soluble materials are preferred. Among them, it is preferred to use easily water-soluble materials, that is, materials having high solubility to water since the control for the concentration of the aqueous dispersant solution is easy. The easily water-soluble dispersant includes, for example, known polymeric compound type surfactants and water-soluble polymeric compounds. As the surfactant, any of nonionic surfactants, anionic surfactants, and cationic surfactants may be used and specific examples thereof include, for example, sodium docecylbenzene sulfate, sodium tetradecyl sulfate, sodium pentadecylsulfate, sodium octyl sulfate, sodium dodecylbenzene sulfonate, sodium oleate, sodium laurate, sodium stearate, and potassium stearate. The water-soluble polymeric compound includes, for example, polyvinyl alcohol, polyvinyl pyrrolidone, hydroxyethyl cellulose, carboxymethyl cellulose, cellulose gum, and polycarboxylic acid compound. The polycarboxylic acid compound includes, for example, polycarboxylic acid such as polyacrylic acid and polystyrene acrylic acid and polycarboxylic acid salt such as ammonium salt or metal salt of the polycarboxylic acid. The dispersant easily decomposed by the acid or the like and transformed into the easily water-soluble material includes, for example, less water-soluble inorganic dispersant, for example, alkaline earth metal salt such as calcium phosphate and calcium carbonate.

Among the dispersants, it is preferred to use those dispersants that can be prepared into an aqueous solution at a concentration of 10% or higher with water at a room temperature (about 25° C.) . The dispersant includes the dispersants described above and, among all, the water-soluble polymeric compounds. Among them, polycarboxylic acid compound is preferred and polycarboxylic acid salt is particularly preferred in view of easy water solubility. By using the water-soluble polymeric compound, preferably, a polycarboxylic acid compound, more preferably, polycarboxylic acid salt as the dispersant, since granulating of the kneaded resin products in the granulating step as the step s3 proceeds easily, a toner with smooth surface and having uniform shape and size can be obtained efficiently. Particularly, since the polycarboxylic acid compound has higher water solubility among the water-soluble polymeric compounds described above and is easily leached into an aqueous layer upon water washing in the cleaning step to be described later, the dispersant can be prevented reliably from remaining on the surface of toner particle by using the polycarboxylic acid compound, preferably, polycarboxylic acid salt.

The water-soluble polymeric compound has a weight average molecular weight of, preferably, 5,000 or more and 50,000 or less and, more-preferably, 5,000 or more and 20,000 or less. In a case where the weight average molecular weight of the water-soluble polymeric compound is less than 5,000, unreacted monomers sometimes remain in the water-soluble polymeric compound to possibly hinder the effect thereof as the dispersant. In a case where the weight average molecular weight of the water-soluble polymeric compound exceeds 50,000, the water solubility is worsened to possibly hinder the effect thereof as the dispersant. The weight average molecular weight of the water-soluble polymeric compound is a value measured by gel permeation chromatography (simply referred to as GPC).

The dispersants can be used each alone or two or more of them can be used together. The amount of the dispersant to be used is, preferably, 5 parts by weight or more and 500 parts by weight or less based on 100 parts by weight of the kneaded resin product. In a case where the amount of use is less than 5 parts by weight, growing of the colorant-containing resin particles formed in the granulating step as the step s3 can not be prevented sufficiently to result in a possibility that the grain size and the grain size distribution range of the obtained toner particles are increased. On the other hand, in a case where the amount of use exceeds 500 parts by weight, since the viscosity of the aqueous dispersant solution tends to increase and also increases bubbling, this may result in a possibility that the resultant colorant-containing resin particles can not be dispersed stably in a liquid mixture of the kneaded resin product and the aqueous dispersant solution.

While the content of the dispersant, that is, the concentration of the dispersant in the aqueous dispersant solution is not particularly restricted and can be properly selected from the wide range, it is, preferably, 5% by weight or more and 40% by weight or less based on the entire amount of the aqueous dispersant solution at a room temperature (about 25° C.) in view of the operation property upon mixing the kneaded resin product and the aqueous dispersant solution, the dispersion stability of the granulated colorant-containing resin particles, etc. In a case where the concentration of the dispersant is less than 5% by weight, since a great amount of the aqueous dispersant solution is required for attaining a suitable ratio of the dispersant used based on the kneaded resin product, the mixing operation of the kneaded resin product and the aqueous dispersant solution is complicated. In a case where the concentration of the dispersant exceeds 40% by weight, since the viscosity of the aqueous dispersant solution increases and bubbles tends to be formed, it becomes difficult to stably disperse the resultant colorant-containing resin particles in the liquid mixture. That is, the amount of the dispersant and water to be used in the aqueous dispersant solution may be determined so as to satisfy a preferred ratio of the dispersant used to the kneaded resin product and a preferred concentration of the dispersant in the aqueous dispersant solution.

The aqueous dispersant solution can be prepared, for example, by dissolving or dispersing an appropriate amount of the dispersant to water. As water, water having an electroconductivity of 20 μS/cm or less is used preferably. Water having the electroconductivity within the range described above can be prepared, for example, by an activated carbon method, ion exchange method, distillation method, or reverse osmosis method. Further, two or more of the methods among them may be combined to prepare water having the electroconductivity within the range described above. Further, it can also be prepared, for example, by using a commercially available pure water production apparatus, for example, Minipure TW-300RU (trade name of products manufactured by Nomura Micro Science Co. Ltd.).

[Granulating Step]

In the granulating step as step s3, a kneaded resin product obtained by dry kneading at step s1 and an aqueous dispersant solution prepared in step s2 are mixed and heated or heated under pressurized, thereby forming colorant-containing resin particles in a liquid mixture of the kneaded resin product and the aqueous dispersant solution.

While the heating temperature in this case is not particularly restricted and can be properly selected from a wide range in accordance, for example, with the type and the characteristic of the binder resin contained in the kneaded resin product (for example, weight average molecular weight and softening point), it is preferably at a temperature equal to or higher than the melting point of the binder resin to equal to or lower than the heat decomposing temperature of the binder resin contained in the kneaded resin product. Also, the pressure is not particularly restricted as well and the mixing operation can be conducted easily in accordance with the type of the binder resin obtained in the kneaded resin product, etc., and a pressure capable of attaining toner particles having desired grain size and shape may be selected properly. However, in a case where the heating temperature is set to 100° C. or higher, the mixing procedure is preferably conducted for preventing boiling of the aqueous dispersant solution, in a pressurized state, that is, under a pressure exceeding saturated vapor pressure of the aqueous dispersant solution at the heating temperature, for example, under a pressure exceeding 1 atm.

Mixing between the kneaded resin product and the aqueous dispersant solution is preferably conducted under stirring and, more preferably, conducted while applying shearing force. The stirring speed is not particularly restricted and the stirring operation can be practiced easily in accordance with the kind of the binder resin such as the crosslinked resin, the colorant, and various additives contained in the kneaded resin product and a value capable of obtaining colorant-containing resin particles having desired grain size, grain size distribution, and shape may be selected properly. Further, also the shearing force is not particularly restricted and mixing operation can easily be conducted in accordance, for example, with the kind of the binder resin such as the crosslinked resin contained in the kneaded resin product, and a shearing force capable of obtaining colorant-containing resin particles having desired grain size, grain size distribution, and shape may be properly selected.

The time for mixing the kneaded resin product and the aqueous dispersant solution is not particularly restricted and can be properly selected from a wide range in accordance with various conditions such as the kind and the amount of use of the binder resin in the kneaded resin product, the kind and the concentration of the dispersant in the aqueous dispersant solution, the heating temperature and it is, for example, about from 10 to 20 min.

As the kneaded resin product, those obtained by melt-kneading the binder resin, the colorant, etc. may be used as they are, or solidification products obtained by cooling after the melt kneading may be used as they are or they may be heated again to return to the molten state and used.

While the mixing ratio of the kneaded resin product and the aqueous dispersant solution is not particularly restricted and can be properly selected within a wide range in accordance with various conditions such as the content of the binder resin in the kneaded resin product, the kind and the content of the dispersant in the aqueous dispersant solution and the aqueous dispersant solution is used preferably in an amount of from 100 to 500 parts by weight based on 100 parts by weight of the kneaded resin product with a view point of efficiently conducting the mixing operation, the succeeding cleaning operation for the colorant-containing resin particles, separating operation for the toner particles, etc.

Mixing of the kneaded resin product and the aqueous dispersant solution is conducted more specifically by using, for example, an emulsifying machine or a dispersing machine. Preferred emulsifying machine and dispersing machine are apparatus capable of receiving the kneaded resin product and the aqueous dispersant solution batchwise or continuously, having heating means or heating means and pressurizing means and capable of mixing the kneaded resin product and aqueous dispersant solution under heating or under heating and pressurization, thereby forming colorant-containing resin particles and discharging the colorant-containing resin particles batchwise or continuously. Further, the emulsifying machine and the dispersing machine having stirring means and capable of mixing the kneaded resin product and the aqueous dispersant solution under stirring are preferred. Further, emulsifying machine and dispersing machine preferably have temperature control means in a mixing vessel for mixing the kneaded resin product and the aqueous dispersant solution. The mixing vessel preferably has pressure proofness, and, more preferably, has a pressure proofness and has pressure control valve. By the use of such a mixing vessel, temperature of the mixture in the vessel is kept substantially constant, and the pressure is also controlled to a predetermined pressure in view of the balance between the melting temperature of the binder resin and the vapor pressure of the aqueous dispersant solution. In a case of mixing the kneaded resin product and the aqueous dispersant solution at a heating temperature of 100° C. or higher, since vessel is used in a pressurized state, it is desirable that the emulsifying machine and the dispersing machine have a mechanical seal and that the mixing vessel can be closed tightly.

Such emulsifying machine and dispersing machine are commercially available. Specific examples include, for example, batchwise emulsifying machines such as Ultratalax (trade name of products, manufactured by IKA Japan Co.), Polytron Homogenizer (name of products, manufactured by KINEMATICA Co.), and T. K. Autohomomixer (trade name of products, manufactured by Tokushu Kika Kogyo Co. Ltd), continuous type emulsifying machines such as Ebaramilder (trade name of products manufactured by Ebara Corp.), T. K. Pipeline Homomixer, T. K. Homomic line flow, T. K. Filmix (names of products manufactured by Tokushu Kika Kogyo Co. Ltd.), Colloid mill (name or products manufactured by Shinko Pantec Co.), Slasher, trigonal wet fine pulverizer (both trade name of products, manufactured by Mitsui Miike Kakoki Co.), Cavitron (name of products manufactured by Eurotec Co.), Fine flow mill (manufactured by Pacific Machinery Engineering Co., Ltd.), etc, Clearmix (trade name of product manufactured by M. Technic Co., and Filmix (trade name of products manufactured by Tokushu Kika Kogyo Co.).

By mixing the kneaded resin product and the aqueous dispersant solution under heating or under heating and pressurization as described above, colorant-containing resin particles at least containing the colorant (hereinafter also referred to as a toner material) in a liquid mixture of the kneaded resin product and the aqueous dispersant solution are formed.

[Cooling Step]

In the cooling step as the step s4, a liquid mixture containing the granulated colorant-containing resin particles (hereinafter also referred to as an aqueous slurry) is cooled. The aqueous slurry is cooled preferably by stopping heating after forming the colorant-containing resin particles in the granulating step as the step s3, and by compulsory cooling by the use of a coolant or spontaneous cooling of allowing the slurry to cool as it is.

In the granulating step, since the liquid mixture of the resin molding product and the aqueous dispersant solution is granulated by heating the mixture to render the kneaded resin product into a molten state, the colorant-containing resin particles just after formation are in a molten state and have tackiness. While the colorant-containing resin particles tend to be adhered to each other and grown in this state but since the dispersant is contained together with the colorant-containing resin particles in the liquid mixture in this embodiment, the colorant-containing resin particles are stabilized by the dispersant and uniformly dispersed in the liquid mixture. Accordingly, growth of the colorant-containing resin particles does not occur in the cooling step and the colorant-containing resin particles can be cooled while maintaining the shape and the size in a state dispersed uniformly in the liquid mixture. Accordingly, toner particles having a volume average grain size, for example, as small as about 3 to 15 μm, with narrow grain size distribution and having uniform shape and size can be obtained.

The liquid mixture (aqueous slurry) is preferably cooled under stirring. When the liquid mixture is cooled with no stirring, the effect of stabilizing the dispersion by the dispersant can not be provided sufficiently to possibly fuse the colorant-containing resin particles to each other in a case where the temperature of the liquid mixture is equal to or higher than the softening point of the binder resin contained in the colorant-containing resin particles. Accordingly, it is preferred to continue stirring of the liquid mixture (aqueous slurry) also in the cooling step.

Further, in a case of granulating the colorant-containing resin particles under pressure at a heating temperature of 100° C. or higher, when pressurization is stopped and pressure in the mixing vessel is returned to an atmospheric pressure in the cooling step, since the aqueous slurry boils to generate a number of bubbles in a state where the temperature of the liquid mixture is 100° C. or higher, subsequent treatment becomes difficult. Accordingly, it is preferred in this case to continue pressurization also in the cooling step. It is preferred that the pressure in the mixing vessel is reduced again to the atmospheric pressure when the temperature of the mixture in the mixing vessel is lowered to 50° C. or lower and it is further preferred to reduce the pressure again to the atmospheric pressure after cooling the mixture in the mixing vessel to a room temperature (about 25° C.).

[Cleaning Step]

In the cleaning step as the step s5, cleaning for the colorant-containing resin particles contained in the liquid mixture is conducted after cooling.

Cleaning for the colorant-containing resin particles is conducted for removing the dispersant and impurities derived from the dispersant, etc. In a case where the dispersant and the impurities remain in the toner particles, it may be a possibility that the charging performance of the obtained toner particles becomes instable and the chargeability is lowered due to the effect of the moisture content in air. Cleaning for the colorant-containing resin particles can be conducted, for example, by water washing. Water washing for the colorant-containing resin particles is preferably conducted repetitively till the electroconductivity of the supernatant separated by centrifugation or the like from the liquid mixture lowers to 100 μS/cm or less, preferably, 10 μS/cm or less. This can reliably prevent the residue of dispersant and impurities further to make the charged amount of the toner particles more uniformly.

It is preferred that water used for in the water washing is water having an electroconductivity of 20 μS/cm or less. Such water can be prepared, for example, by an activated carbon method, ion exchange method, distillation method or reverse osmosis method. Further, water may be prepared by combining two or more of the methods described above. The water washing for the colorant-containing resin particles may be conducted either batchwise or continuously. Further, while the temperature of the cleaning water is not particularly restricted, it is preferably within a range from 10 to 80° C.

[Separation Step]

In the separation step as the step s6, colorant-containing resin particles are separated and recovered from the liquid mixture containing the colorant-containing resin particles. The colorant-containing resin particles can be separated from the liquid mixture in accordance with a known method and, for example, it can be conducted by filtration, filtration under suction, centrifugal separation, etc.

In a case of conducting the cleaning step as the step s5 after the separation step as the step s6, the colorant-containing resin particles can be cleaned by water washing the separated colorant-containing resin particles. Water washing is preferably repeated till the electroconductivity of cleaning water after cleaning the colorant-containing resin particles is lowered to 100 μS/cm or less, preferably, 10 μS/cm or less. This can reliably prevent the dispersant and the impurities from remained further and render the charged amount of the toner particles more uniformly.

[Drying Step]

In the drying step as the step s7, the separated colorant-containing resin particles are dried and optionally classified to obtain the toner particles of the invention.

Drying can be conducted in accordance with a known method such as a freeze drying method or air stream drying method. Upon drying the toner particles, drying is preferably conducted after checking the absence or presence of impurities by a conductivity meter or the like.

Classification can be conducted in accordance with a known method. For example, it can be conducted by a dry classification method such as a pneumatic classification method. For example, a wet classification method such as a wet cyclone method can be used together. Toner particles having a desired grain size distribution can be obtained by classification. Classification may also be conducted before drying.

The thus obtained toner particles can be used as they are as the toner. Further, surface modification of the toner particles can also be conducted by externally adding an external additive such as a surface modifier to the toner particles. The surface modifier includes, for example, metal oxide particles such as of silica and titanium oxide. Further, those applied with a surface modifying treatment such as hydrophobic treatment to the surface modifier described above, for example, by a silane coupling agent can also be used. While the ratio of the additive used relative to the toner particles is not particularly restricted, it is, preferably, 0.1 part by weight or more and 10 parts by weight or less and, more preferably, 1 part by weight or more and 5 parts by weight or less based on 100 parts by weight of the toner particles.

As described above, a toner of the invention comprising toner particles or a composition containing toner particles and the external additive can be obtained. When the toner of the invention is manufactured as described above, the process transfers from the step s7 to the step s8 to complete the manufacture of the toner according to this embodiment. By manufacturing the toner using the toner manufacturing method according to this embodiment, a toner excellent in the anti-hot offsetting property, having a volume average grain size for example as small as about 3 to 15 μm with no classification, having narrow grain size distribution and having uniform shape and size, further excellent in the surface smoothness and with uniform charging performance can be obtained. Further, a toner of the invention with the average circularity of 0.90 or more and less than 0.97 and excellent in the cleaning property can be obtained.

The toner of the invention obtained by the toner manufacturing method according to the invention can be used, for example, for the development of electrostatic images in the image formation by electrophotography, static recording method, etc. and the development of magnetic latent images in the image formation by magnetic recording method, etc.

Particularly, since the toner of the invention is uniform and free from variety of the charging performance, it can be used suitably as a toner for the development of electrostatic images used for the development of electrostatic images. That is, by the use of the toner according to the invention, it is possible to suppress variety of the charged amount of the toner, suppress lowering of the image density and the occurrence of white background fogging, and images at high quality with no such image defects can be formed.

Further, since the toner according to the invention contains the crosslinked resin containing the THF insoluble component as the binder resin and is excellent in the anti-hot offsetting property, occurrence of the hot offsetting phenomenon can be suppressed by using the toner of the invention.

The toner according to the invention can be sued as a one-component developer or a two-component developer. In a case of using the toner of the invention as a one-component developer, for example, a non-magnetic one-component developer for use in electrostatic images, electrostatic images on the surface of a photoreceptor can be developed by triboelectrically charging the toner of the invention using a blade or a fur brush, conveying the same being deposited on a developing sleeve and supplying the same to the surface of the photoreceptor.

In a case of use as the two-component developer, the toner of the invention is used together with a carrier. The carrier used together with the toner of the invention is not particularly restricted and those used customarily in this field can be used and, for example, a single or composite ferrite comprising iron, copper, zinc, nickel, cobalt, manganese or chromium, or those using them as the carrier core particles and coating the surface of the carrier core particles with a coating material are used. The coating material can be selected properly in accordance with the ingredients contained in the toner and includes, for example, polytetrafluoroethylene, monochlorotrifluoroethylene polymer, polyvinylidene fluoride, silicone resin, polyester resin, styrenic resin, acrylic resin, polyamide, polivinyl butural, nigrosine, aminoacrylate resin, basic dyes and lakes thereof, fine silica powder, and fine alumina powder. The coating materials can be used each alone or two or more of them can be used together. The volume average particle size of the carrier is preferably from 30 μm or more and 100 μm or less. By the use of the carrier having the volume average grain size within the range described above, since the toner of the invention having the volume average grain size as small as about 3 to 15 μm can be charged sufficiently, scattering of the toner, etc. can be prevented. Further, fluidity as the developer can be improved and image fogging due to stirring failure of the developer can be prevented.

EXAMPLES

The invention is to be described specifically with reference to examples and comparative examples, but the invention is not restricted by them. In the followings "part(s)" and "%" means "part(s) by weight" and "% by weight" respectively unless otherwise specified.

[Preparation of Water]

In the following examples and comparative examples, water having an electroconductivity of 0.5 μS/cm was used for the preparation of the aqueous dispersant solution and cleaning for the colorant-containing resin particles (toner particles). Water was prepared from city water by using a super-purified water production apparatus (trade name of products: Minipure TW-300RU, manufactured by Nomura Micro Science Co.). The electroconductivity of the water was measured by using a Lacom tester EC-PHCON 10 (trade name of products manufactured by Iuchi Seieido Co. (now as Azu One Co.).

[THF Insoluble Component of Resin in Toner]

At first, 1 g of a toner is placed in a cylindrical filter paper and subjected to a Soxhlet extractor. It is refluxed under heating for 6 hours by using 100 mL of tetrahydrofuran as a solvent and an ingredient in the sample soluble to THF (hereinafter sometimes referred to as THF soluble ingredient) is extracted with THF. After removing the solvent from the liquid extracts containing the extracted THF soluble ingredient, the THF soluble ingredient is dried at 100° C. for 24 hours and the weight $W_T$ (g) of the obtained THF soluble ingredient is weighted. The ratio $P_T$ of the THF insoluble component in the toner (wt %) is calculated according to the following equation (1) based on the weight $W_T$ of the determined THF soluble ingredient (g) and the weight (1 g) of the sample used for the measurement:

$$P_T(\text{wt }\%)=\{1(\text{g})-W_T(\text{g})\}/1(\text{g})\times 100 \quad (1a)$$

Further, in the same manner, the ratio $P_1$ of the THF insoluble component (wt %) in the mixture formed by mixing the ingredients other than the resin used for the toner by the identical blending ratio of the toner is determined. Based on the obtained values for $P_T$ and $P_1$ and the ratio $X_0$ (wt %) of the resin in the toner, the ratio $P_0$ (wt %) of the THF insoluble component of the resin in the toner is calculated according to the following equation (1b).

$$P_0=\{P_T-(1-X_0)\times P_1)\}/X_0 \quad (1b)$$

[Grain Size and Grain Size Distribution]

The volume average grain size $D_{50}$, the grain size distribution, and the fluctuation coefficient of the toner particles were measured by using Coulter Multisizer II (trade name of products manufactured by Coulter Co. (now as Beckman Coulter Co.). The number of particles measured was 50,000 count and the aperture diameter was 100 μm. As the value for the fluctuation coefficient is smaller, this means that the grain size distribution is narrower.

[Average Circularity]

The average circularity of the toner particles was measured by using a flow type particle image analyzer (trade name of products: FPIA-2000, manufactured by Toa Medical Electronics Co. (now as Sysmex Co.) . The average circularity is defined as: (Peripheral length of a circle having an identical projection area with a particle image)/(Peripheral length of a particle projection image) in a particle image detected by the measuring apparatus, which is a value of 1 or less. As the value for the average circularity approaches 1, this means that the shape of the toner particles approaches a true sphere.

[Softening Point of Resin]

Softening points of resins used in the following examples and comparative examples are measured as described below. Using a fluidity characteristic evaluation apparatus (trade name of products: Flow tester CFT-100C, manufactured by Shimazu Seisakusho Co.), 1 g of sample was heated at a temperature elevation rate of 6° C. per min (6° C./min) while applying 10 kg/cm$^2$ of load such that the sample was extruded from a die (nozzle) and the temperature at which one-half of the sample was flown out of the dye was determined as a softening point. A die having 1 mm opening diameter and 1 mm length was used.

[Glass Transition Point (Tg) of Resin]

The glass transition point (Tg) of the resin used in the following examples and comparative examples was measured as described below. Using a differential scanning calorimeter (trade name of products: DSC 220, manufactured by Seiko Electronics Industry Co.), 1 g of a sample was heated at a temperature elevation rate per min of 10° C. to determine a DSC curve in accordance with Japanese Industrial Standards (JIS) K 7121-1987. A temperature at an intersection between a straight line as the extension of the base line on the high temperature side of an endothermic peak corresponding to the glass transition of the obtained DSC curve to the low temperature side and a tangential line drawn at a point where the gradient is maximum relative to the curve from the rising point to the top of the peak is determined as a glass transition point (Tg).

[Weight Average Molecular Weight of Resin and Dispersant]

The weight average molecular weight of the resin and the dispersant used in the following examples and comparative examples was measured as described below. Using a GPC apparatus (trade name of products: HLC-8220GPC, manufactured to Tosoh Corp.) and a 0.25 wet % tetrahydrofuran solution of the sample was used as a sample solution, which was measured at an injection amount of 100 mL at a temperature of 40° C. A calibration curve for the molecular weight was prepared by using standard polystyrene.

[Melting Point of Wax]

The melting point of the wax used in the following examples and comparative examples was measured as described below. Using a differential scanning calorimeter (trade name of product: DSC 220, manufactured by Seiko Electronics Industry Co.), a procedure of elevating the temperature of 1 g of the sample from 20° C. to 150° C. at a temperature elevation rate per min of 10° C. and then quenching the temperature from 150° C. to 20° C. was repeated twice, to determine a DSC curve. The temperature at the top of the endothermic peak corresponding to the melting of the DSC curve measured by the second operation was determined as the melting point of the wax.

Example 1

[Dry Kneading Step]

Copper phthalocyanine (C. I. pigment blue 15:3) as a colorant was added to a crosslinked polyester resin comprising 25 parts of terephthalic acid, 20 parts of isophthalic acid, 5 parts of trimellitic acid anhydride, 40 parts of polyoxypropylene (2.2)-2,2-bis(4-hydroxyphenyl) propane, and 10 parts of ethylene glycol as raw materials (glass transition point (Tg): 62° C., softening point: 130° C., THF insoluble component: 0.5% by weight, weight average molecular weight: 75,000), they were melt kneaded for 40 min by a kneader set to a temperature of 140° C., to prepare a master batch at a colorant concentration of 40% by weight. Polyoxypropylene(2.2)-2,2-bis(4-hydroxyphenyl)propane is a compound formed by adding 2.2 mol in average of propylene oxide to 1 mol of 2,2-bis(4-hydroxyphenyl)propane.

Then, 80.5 parts of the same crosslinked polyester resin as used for the preparation of the master batch (THF insoluble component: 0.5% by weight), 12.5 parts of the master batch prepared as described above (colorant concentration: 40% by weight), 5 parts of paraffin wax (melting point: 75° C.) as a wax, and 2 parts of a charge controller (trade name of products: Bontron E84, manufactured by Orient Chemical Industry Co. Ltd.) were mixed and dispersed for 3 min in a mixer (trade name of products: Henschel mixer, manufactured by Mitsui Mining Co.), to obtain a starting mixture. The obtained starting mixture was melt kneaded and dispersed by using a twin-screw extruder (trade name of products: PCM-30, manufactured by Ikegai Co., Ltd.), to prepare a kneaded resin product. The operation condition for the twin-screw extruder was at a cylinder setting temperature of 110° C., a number of rotation of barrel per min of 300 rpm, and a starting material mixture feeding speed of 20 kg/hr.

[Preparation Step for Aqueous Dispersant Solution]

100 parts of ammonium polyacrylate as a water-soluble polymeric compound (manufactured by Toa Gosei Co., weight average molecular weight: 10,000) as a dispersant and 400 parts of water were mixed to prepare an aqueous dispersant solution at a dispersant concentration of 20% by weight.

[Granulating Step]

100 parts of the kneaded resin product and 400 parts of the aqueous dispersant solution (dispersant concentration: 20% by weight) prepared as described above were charged in a metal mixing vessel having a pressure control valve, heating means, and rotor-stator type stirring means (bore diameter 30 mm) and stirred and mixed for 10 min while heating such that the liquid temperature of the liquid mixture in the mixing vessel was 150° C., to form colorant-containing resin particles. The rotational speed of the rotor-stator type stirring means was set to 10,000 rotation on every min (10,000 rpm).

[Cooling Step]

After forming the colorant-containing resin particles as described above, the heating was stopped, and the liquid mixture containing the formed colorant-containing resin particles (hereinafter referred to as aqueous slurry) was cooled while stirring till the liquid temperature was lowered to 20° C. The rotational speed of the rotor-stator stirring means was set to 10,000 rotation per min (10,000 rpm).

[Cleaning Step, Separation Step, and Drying Step]

Then, colorant-containing resin particles were cleaned by using water having an electroconductivity of 0.5 μS/cm (temperature: 20° C.). Cleaning was conducted by mixing the obtained aqueous slurry and water (electroconductivity: 0.5 μS/cm) such that the solid content was 10% and stirred for 30 min by using a turbine type stirring blade while setting the rotational speed of the stirring blade to 300 rotation per min (300 rpm). The cleaning operation was conducted repetitively till the electroconductivity of the supernatant separated centrifugally from the mixture after the stirring reached 10 μS/cm or less. Then, the solid matters were separated centrifugation and dried to obtain about 100 parts of the colorant-containing resin particles.

When the obtained colorant-containing resin particles were observed under a scanning type electron microscope (simply referred to as SEM), substantially circular particles were observed. Further, particles grown by adhesion of a plurality of particles to each other were not contained.

The obtained colorant-containing resin particles were freeze-dried to obtain toner particles having a volume average grain size of 5.6 μm, a fluctuation coefficient of 26, and an average circularity of 0.96. The THF insoluble component of the crosslinked polyester resin in the obtained toner particles was 0.5% by weight. 0.7 part of silica particles with an average primary grain size of 20 nm and one part of titanium oxide applied with hydrophobic treatment by a silane coupling agent were mixed with 100 parts of the toner particles, to obtain a toner according to the invention.

Example 2

Colorant-containing resin particles were obtained by the same operation as in Example 1 except for using, instead of the crosslinked polyester resin with 0.5% by weight of the THF insoluble component, a crosslinked polyester resin having 10% by weight of the THF insoluble component comprising 35 parts of terephthalic acid, 10 parts of isophthalic acid, 5 parts of trimellitic acid anhydride, 20 parts of polyoxyethylene (2.2)-2,2-bis(4-hydroxyphenyl) propane, and 10 parts of ethylene glycol as the starting material (glass transition point (Tg): 62° C., softening point: 130° C., weight average molecular weight: 30,000) in the preparation of the kneaded resin product in the dry kneading step. When the obtained colorant-containing resin particles were observed under SEM, substantially circular particles were observed in the same manner as in Example 1. Further, particles grown by adhesion of a plurality of particles to each other were not contained.

The obtained colorant-containing resin particles were freeze-dried to obtain toner particles having a volume average grain size of 6.3 μm, a fluctuation coefficient of 28 and an average circularity of 0.94. The THF insoluble component of the crosslinked polyester resin in the obtained toner particles was 8% by weight. 0.7 part of silica particle and 1 part of titanium oxide identical with those used in Example 1 were mixed to 100 parts of the toner particles, to obtain the toner according to the invention.

Example 3

Colorant-containing resin particles were obtained by the same operation as in Example 1 except for using, instead of the crosslinked polyester resin with 0.5% by weight of the THF insoluble component, a crosslinked polyester resin with 29% by weight of the THF insoluble component comprising 40 parts of terephthalic acid, 8 parts of trimellitic acid anhydride, 2 parts of dodecenyl succinic acid anhydride, 40 parts of polyoxyethylene (2.2)-2,2-bis(4-hydroxyphenyl) propane, and 10 parts of ethylene glycol as the starting material (glass transition point (Tg): 59° C., softening point: 145° C., weight average molecular weight: 30,000) in the preparation of the kneaded resin product in the dry kneading step. When the obtained colorant-containing resin particles were observed under SEM, substantially circular particles were observed in the same manner as in Example 1. Further, particles grown by adhesion of a plurality of particles to each other were not contained.

The obtained colorant-containing resin particles were freeze-dried to obtain toner particles having a volume average grain size of 8.2 μm, a fluctuation coefficient of 30, and an average circularity of 0.90. The THF insoluble component of the crosslinked polyester resin in the obtained toner particles was 25% by weight. 0.7 part of silica particle and 1 part of titanium oxide identical with those used in Example 1 were mixed to 100 parts of the toner particles, to obtain the toner according to the invention.

Comparative Example 1

Toner particles having a volume average particle size of 6.5 μm, a fluctuation coefficient of 30, and an average circularity of 0.97 were obtained by the same operation as in Example 1 except for using, instead of the crosslinked polyester resin with the THF insoluble component of 0.5% by weight, a not-crosslinked polyester resin not containing the THF insoluble component, comprising terephthalic acid, isophthalic acid, neopentyl glycol, and ethylene glycol as the starting material (glass transition point (Tg): 60° C., softening point: 110° C., THF insoluble component: 0% by weight, weight average molecular weight: 20,000) in the preparation of a kneaded resin product in the dry kneading step. The THF insoluble component in the polyester resin in the obtained toner particles was 0% by weight. 0.7 part of silica particles and one part of titanium oxide identical with those used in Example 1 were mixed with 100 parts of the toner particles to obtain a toner.

Comparative Example 2

Toner particles having a volume average particle size of 6.7 μm, a fluctuation coefficient of 30, and an average circularity of 0.97 were obtained by the same operation as in Example 1 except for using, instead of the crosslinked polyester resin with the THF insoluble component of 0.5% by weight, a not-crosslinked polyester resin not containing the THF insoluble component, comprising terephthalic acid, isophthalic acid, neopentyl glycol, and ethylene glycol as the starting material (glass transition point (Tg): 57° C., softening point: 100° C., THF insoluble component: 0% by weight, weight average molecular weight: 20,000) in the preparation of a kneaded resin product in the dry kneading step. The THF insoluble component in the polyester resin in the obtained toner particles was 0% by weight. 0.7 part of silica particles and one part of titanium oxide identical with those used in Example 1 were mixed with 100 parts of the toner particles to obtain a toner.

Reference Example

Operation was conducted in the same manner as in Example 1 except for using, instead of the crosslinked polyester resin with 0.5% by weight of the THF insoluble component, a crosslinked polyester resin with 40% by weight of the THF insoluble component comprising 40 parts of terephthalic acid, 8 parts of trimellitic acid anhydride, 2 parts of dodecenyl succinic acid anhydride, 30 parts of polyoxyethylene (2.2)-2,2-bis(4-hydroxyphenyl) propane, and 10 parts of ethylene glycol as the starting material (glass transition point (Tg): 60° C., softening point: 165° C., weight average molecular weight: 30,000) in the preparation of the kneaded resin product in the dry kneading step, and further changing the liquid temperature of the liquid mixture in the granulating step to 170° C. However, colorant-containing resin particles could not be formed in the granulating step and the toner could not be manufactured.

<Characteristic Evaluation >

96 parts by weight of ferrite particles with a volume average particle size of 60 μm were mixed and stirred as a carrier to each of 4 parts by weight of the toners obtained in Examples 1 to 3 and Comparative Examples 1 and 2, to prepare a two-component developer. The following evaluation was practiced by using the obtained two-component developer.

[Anti-Hot Offsetting Property]

The obtained two-component developer was charged in a developing device of a test printer obtained by removing a fixing device from a commercially available printer (trade name of products: LIBRE AR-S505, manufactured by Sharp Corp.), and solid images of a rectangular shape of 20 mm length and 50 mm width were formed in a not fixed state on A4 size recording paper according to Japanese Industrial Standard (JIS) P0138 while conditioning the toner deposition amount to 0.6 mg/cm$^2$. Using an external fixing machine, the formed not yet fixed toner images were fixed while setting the passing speed of recording paper to 120 mm per sec (120 mm/sec) to form images for evaluation. As the external fixing machine, an oilless type fixing device taken out of a commercially available full color copier (trade name of products; LIBRE AR-C260, manufactured by Sharp Corp.) modified such that the surface temperature of the heat roller for fixing could be set to an optional value was used. The oilless type fixing device means a fixing device capable of conducting fixing without coating a releasing agent such as a silicone oil to the fixing heat roller.

The formed images for evaluation were observed visually and judged whether the offset phenomenon of re-transferring toner images from a fixing heat roller to a non-image area which should remain as white background of the recording paper occurred or not.

The operation was repeated while elevating the surface temperature of the fixing heat roller from 100° C. to 210° C. each at a step of 5° C. successively to determine the range for the surface temperature of the fixing heat roller at which offset phenomenon did not occur, which was defined as a non-offset region (° C.). The minimum value in the non-offset region was defined as a minimum fixing temperature (° C.), while the maximum value in the non-offset region was defined as a hot offsetting generation temperature (° C.). The anti-hot offsetting property was evaluated as favorable (A) in a case where the non-offsetting region is 40° C. or higher and judged as poor (B) in a case where non-offsetting region was lower than 40° C.

[Fixing Strength]

For the images for evaluation formed at a surface temperature of the fixing heat roller of 150° C. in the evaluation for the anti-hot offsetting property, optical reflection density for the image area where solid images were formed was measured by using a reflection densitometer (trade name of products: RD918, manufactured by Macbeth Co.), which was defined as an image density. Then, after adhering a tape to the image area of the images for evaluation, the tape was peeled and the image density of the image area was measured again. The fixing ratio (%) was calculated based on the image density before adhesion of the tape and the image density after peeling the tape in accordance with the following equation (2), which was defined as an evaluation index for the fixing strength. The fixing strength was evaluated as favorable (A) in a case where the fixing ratio was 80% or more, while it was evaluated as poor (B) in a case where the fixing ratio was less than 80%.

$$\text{Fixing ratio (\%)}=(\text{Image density after peeling}/\text{Image density before adhesion})\times 100 \quad (2)$$

[Image Density]

For the images for evaluation formed at the surface temperature of the fixing heat roller of 150° C. in the evaluation for the anti-hot offsetting property, the optical reflection density of the image area was measured by using a reflection densitometer (trade name of product: RD918, manufactured by Macbeth Co.), which was defined as the image density. It was evaluated as favorable (A) in a case where the image density was 1.40 or more and evaluated as poor (B) in the case where the image density was less than 1.40.

[White Background Fogging]

For the images for evaluation formed at the surface temperature of the fixing heat roller of 150° C. in the evaluation for the anti-hot offsetting property, the optical reflection density of the white paper portion as the non-image area was measure by using a reflection densitometer (trade name of product: RD918, manufactured by Macbeth Co.), which was defined as the image density for non-image area.

Further, the image density for the not-used recording paper was measured by using the reflection densitometer described above. The image density of the non-image area of the images for evaluation was converted into an image density based on the image density of the not-used recording paper (0.000), and the value was determined as a difference between the image density for the not-used recording paper and the image density for the non-image area of the images for evaluation (hereinafter referred to as a fog value) . It was evaluated as favorable (A) in a case where the fog value was 0.005 or less and evaluated as poor (B) in a case where the fog value exceeded 0.005.

[Transfer Ratio]

A transfer ratio was determined based on the toner weight Mp on the surface of a sample paper copied in accordance with a predetermined chart and a weight Md of the toner remained on the photoreceptor in accordance with the following equation, and it was evaluated as favorable (A) in a case where the transfer ratio was 90% or more and evaluated as poor (B) in a case where it was less than 90%.

$$\text{Transfer ratio (\%)}=[Mp/\{Md+Mp)]\times 100$$

[Overall Evaluation]

Overall evaluation was conducted by collecting the results of evaluation described above. In the overall evaluation, it was evaluated as favorable (A) in a case of including none of the items evaluated as (B) and evaluated as poor (B) in a case of including one or more items evaluated as (B).

The evaluation results are shown in Table 1. In Table 1, the volume average grain size of the toner particles is indicated as $D_{50}$.

TABLE 1

| Sample | | THF insoluble component of binder resin [wt %] | Toner particle $D_{50}$ [μm] | Toner particle Fluctuation Coefficient | Toner particle Average Circularity | Anti-hot offsetting property: Lowest fixing temperature (° C.) | Anti-hot offsetting property: Hot offsetting generation temperature (° C.) | Anti-hot offsetting property: Non-offsetting region (° C.) | Anti-hot offsetting property: Evaluation |
|---|---|---|---|---|---|---|---|---|---|
| Example | 1 | 0.5 | 5.6 | 26 | 0.96 | 140 | 190 | 50 | A |
| | 2 | 10 | 6.3 | 28 | 0.94 | 140 | 185 | 45 | A |
| | 3 | 29 | 8.2 | 30 | 0.90 | 140 | 190 | 50 | A |
| Comp. | 1 | 0 | 6.5 | 30 | 0.97 | 145 | 160 | 15 | B |
| Example | 2 | 0 | 6.7 | 30 | 0.97 | 145 | 155 | 10 | B |

| Sample | | Fixing strength: Fixing ratio | Fixing strength: Evaluation | Image density: Measured value | Image density: Evaluation | White background fog: Fog value | White background fog: Evaluation | Transfer ratio: Measured value | Transfer ratio: Evaluation | Overall evaluation |
|---|---|---|---|---|---|---|---|---|---|---|
| Example | 1 | 90 | A | 1.42 | A | 0.003 | A | 90 | A | A |
| | 2 | 90 | A | 1.45 | A | 0.004 | A | 90 | A | A |
| | 3 | 90 | A | 1.45 | A | 0.004 | A | 90 | A | A |
| Comp. | 1 | 90 | A | 1.42 | A | 0.008 | B | 90 | A | B |
| Example | 2 | 90 | A | 1.44 | A | 0.008 | B | 90 | A | B |

It can be seen from Table 1 that toners of Examples 1 to 3 manufactured by the manufacturing method according to the invention using the crosslinked resins containing the THF insoluble component as the binder resin are excellent in each of the anti-hot offsetting property, the low temperature fixing property, and the fixing property to recording paper as the transfer material. Further, it can be seen that the toners of Examples 1 to 3 have preferred grain size and shape as the toner for the development of static charges, show narrow grain size distribution, are excellent in the transferability to the transfer material, and can form images at high quality having sufficient image density on the transfer material and with no image defects such as white background fogging.

On the contrary, it was found that toners of Comparative Examples 1 and 2 manufactured by using resins not containing the THF insoluble component as the binder resin have a narrow non-offset region and no sufficient anti-offsetting property. Further, it was found that white background fogging was generated in the images formed by using the toners of Comparative Examples 1 and 2.

As has been described above, by using the manufacturing method of the toner according to the invention, a toner containing a crosslinked resin having the THF insoluble component as the binder resin, excellent in the anti-hot offsetting property, with no variance of the charging performance and capable of forming images with no lowering of the image density and with no white background fogging can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner manufacturing method comprising:

a dry kneading step of dry kneading a crosslinked resin at least containing a tetrahydrofuran insoluble component and a colorant, a granulating step of mixing a kneaded resin product obtained by the dry kneading and an aqueous dispersant solution containing a dispersant, and heating or heating and pressurizing them to form colorant-containing resin particles in the liquid mixture of the kneaded resin product and the aqueous dispersant solution, a cooling step of cooling the liquid mixture containing the formed colorant-containing resin particles, and a separation step of separating the colorant-containing resin particles from the liquid mixture.

2. The toner manufacturing method of claim 1, wherein the crosslinked resin contains the tetrahydrofuran insoluble component by 0.5% by weight or more and 30% by weight or less.

3. The toner manufacturing method of claim 1, wherein a softening point of the crosslinked resin is equal to or lower than 150° C.

4. The toner manufacturing method of claim 1, wherein a softening point of the crosslinked resin is within a range of 60° C. to 150° C.

5. The toner manufacturing method of claim 1, wherein a glass transition point of the crosslinked resin is within a range of 30° C. to 80° C.

6. The toner manufacturing method of claim 1, wherein a glass transition point of the crosslinked resin is within a range of 40° C. to 70° C.

7. The toner manufacturing method of claim 1, wherein a weight average molecular weight of the crosslinked resin is within a range of 5,000 to 500,000.

8. The toner manufacturing method of claim 1, wherein the crosslinked resin is a crosslinked polyester resin.

9. The toner manufacturing method of claim 1, wherein the dispersant is a water-soluble polymeric compound.

10. The toner manufacturing method of claim 9, wherein a weight average molecular weight of the water-soluble polymeric compound is within a range of 5,000 to 50,000.

11. The toner manufacturing method of claim 9, wherein a weight average molecular weight of the water-soluble polymeric compound is within a range of 5,000 to 20,000.

12. The toner manufacturing method of claim 9, wherein the water-soluble polymeric compound is a polycarboxylic acid compound.

13. The toner manufacturing method of claim 1, wherein a wax is further kneaded together with the crosslinked resin and the colorant in the dry kneading step.

* * * * *